United States Patent [19]

Covey

[11] Patent Number: 4,920,449

[45] Date of Patent: Apr. 24, 1990

[54] CONDUCTIVE BONDING OF COMPOSITE STRUCTURES

[75] Inventor: James H. Covey, Snohomish, Wash.

[73] Assignee: The Boeing Company, Seattle, Wash.

[21] Appl. No.: 145,048

[22] Filed: Jan. 19, 1988

[51] Int. Cl.[5] ..... H05F 3/02

[52] U.S. Cl. ..... 361/216; 361/218; 244/1 A

[58] Field of Search ..... 361/212, 215, 216, 217, 361/218, 220; 29/825, 845, 857, 854, 855; 244/1 A; 174/2, 6; 439/92, 96, 97

[56] References Cited

U.S. PATENT DOCUMENTS

| | | | |
|---|---|---|---|
| 2,181,835 | 6/1939 | Place | 524/575.5 |
| 2,186,482 | 1/1940 | Frank | 174/7 X |
| 2,250,280 | 5/1940 | Starbird | 439/426 |
| 3,481,803 | 12/1969 | Hewitt | 156/73.5 |
| 3,689,334 | 9/1972 | Dermody | 156/73.5 |
| 3,755,713 | 8/1973 | Paszkowski | 361/218 |
| 3,906,308 | 9/1975 | Amason et al. | 361/218 |
| 3,989,984 | 11/1976 | Amason et al. | 361/218 X |
| 4,479,163 | 10/1984 | Bannink, Jr. et al. | 361/218 |
| 4,489,906 | 12/1984 | Fellas | 244/1 A |
| 4,502,092 | 2/1985 | Bannink, Jr. et al. | 361/218 |
| 4,551,189 | 11/1985 | Peterson | 156/73.5 |
| 4,628,402 | 12/1986 | Covey | 361/218 |
| 4,630,168 | 12/1986 | Hunt | 361/218 |
| 4,642,727 | 2/1987 | Dalal | 361/220 X |
| 4,681,497 | 7/1987 | Berecz | 361/218 X |
| 4,755,904 | 7/1988 | Brick | 361/218 X |

FOREIGN PATENT DOCUMENTS

| | | | |
|---|---|---|---|
| 3415001 | 10/1985 | Fed. Rep. of Germany | 439/97 |
| 1000192 | 1/1986 | Japan . | |

OTHER PUBLICATIONS

R. O. Brick, "Multipath Lightning Protection for Composite Structure Integral Fuel Tank Design," 10th International Aerospace and Ground Conference on Lightning and Static Electricity, Paris, 1985, pp. 149–155.

*Primary Examiner*—Michael L. Gellner
*Assistant Examiner*—Brian W. Brown
*Attorney, Agent, or Firm*—Seed and Berry

[57] ABSTRACT

Two composite structures are fastened together using an electrically conductive, threaded fastener. The composite structures have insulating surface regions and inner regions which contain conductive fibers. The threaded fastener is provided with large contact areas through the inner regions to facilitate discharge of high curent densities from the composite materials while minimizing localized heating. This significantly increases the life of the composite material.

17 Claims, 1 Drawing Sheet

FIG. 1
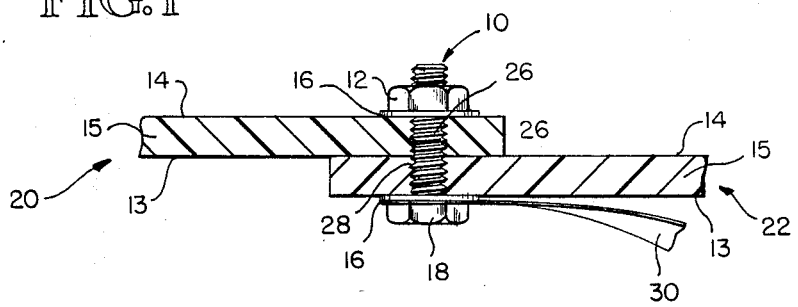
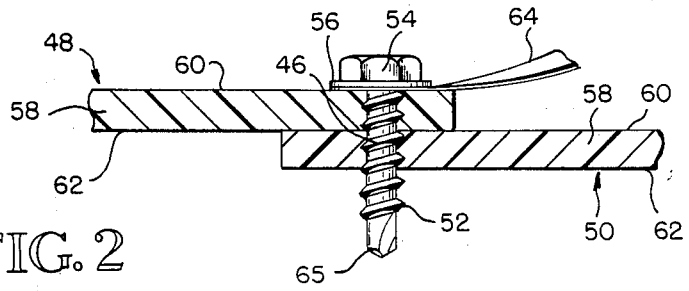
FIG. 2

CONDUCTIVE BONDING OF COMPOSITE STRUCTURES

DESCRIPTION

Statement of Government Interest

The United States Government has certain rights in this invention.

TECHNICAL FIELD

U.S. Pat. Application Ser. No. 07/122,678 filed Oct. 23, 1987, by James H. Covey, contains subject matter similar to the subject matter of the present invention.

This invention relates generally to electrically bonding two materials together, and more particularly, to a threaded fastener to provide electrical coupling between the surface and the inner region of a material.

BACKGROUND ART

Recent advancements in composite structures have produced materials of sufficient strength to permit their use in aircraft structures. The composite structures are much lighter in weight than metal, making their use preferred in an aircraft structure. Exposed aircraft surfaces, including the tail, rudder, and wing portions, may include a composite structure.

The composite structure often includes a surface region made of an electrically insulated material and various types of inner region materials which are electrically conductive. Static charge builds up on the surface of the aircraft structure as it flies through the air. Often, the aircraft flies through clouds, winds or heavy storms, which places large static charges on various parts of the aircraft structure. The static charges build up on the insulating surface until the charge density is sufficiently high to permit discharge to a different part of the aircraft. This creates sparks or electrical arcing from the insulating surface region to the discharge location. The discharge point may be metal screws, sheets of metal, engine mounts or other portions of the aircraft. A spark of this nature is extremely hot and creates high temperature heating of a localized area in the spark region. A graphite composite structure has very good fatigue properties, but the epoxy part of the composite is susceptible to damage by very high temperatures, such as those produced by an arc. Graphite tends to conduct better at very high temperatures than metal, whereas metal conducts better than graphite at room temperature. At lower temperatures metal conducts better than the composite, the resistance being lower. When a spark begins to occur and localized heating begins to take place, the composite heats up and conducts much better than metal, thus providing a lower resistance current path for electricity, which creates an even greater heating effect in the composite structure. Similar problems occur from lightning strikes.

A further safety problem may occur when an electrical device such as a pump is attached to a composite structure. A fuse is connected in series with various parts of the pump to cut off the supply of electric current should it become too high. A current that would trip the fuse is referred to as fault current. Under normal circumstances when a fault current exits the fuse will trip and protect the pump and prevent a fire from starting within the electrical wiring. If the pump is connected by a metal fastener to the composite structure it is possible that arcing or other heating current flow may cause heating at the graphite thus making it a better conductor than metal at this temperature. The fault current would then begin to flow in the graphite composite structure and bypass the fuse circuit completely. Significant current could flow to the pump bypassing the fuse causing a fire or destruction of the pump. This is even more likely if a lightning strike occurs.

Previous patents deal with the problem of static charge buildup on aircraft structures and attempt various solutions to these problems. Pat. No. 2,250,280, to Starbird, describes an electrical bonding member having protrusions, the bonding member being placed between two sheets of metal to insure better contact between the metal. Pat. No. 3,906,308, to Amason et al., describes a lightning protection system which provides metal strips affixed to the dielectric surface and grounded to provide dwell points for lightning current. Pat. No. 3,989,984 teaches use of an outer metallic layer formed from sprayed metal and ground connection to the metallic layer, including a wire screen fused with sprayed metal onto the dielectric layer to protect the composite structure and provide conductive areas for transfer of lightning current.

Pat, Nos. 4,502,092 and 4,479,163, to Bannink, Jr. et al., describe lightning protection systems for graphite composite aircraft skins. The composite structure disclosed in these patents is similar to that of the present invention; however, the approach taught by Bannink, Jr. et al. is to use an insulating layer 42 to electrically insulate the fastener 32 from the composite structure.

Pat. No. 4,628,402, to Covey, deals with the same composite structure and electrical charge-carrying problem as the present invention; however, it solves this problem by placing a larger dielectric layer over the metal fastener and then a conductive region on top of the composite structure spaced a distance away from the fastener to increase the graphite area through which the current flows to thus lower the temperature and the current through a small area in the graphite material.

Pat. No. 4,630,168, to Hunt, deals with a similar problem in similar composite structure by covering the top of the metallic fastener with an insulating layer.

Pat. No. 4,681,497, to Berecz, teaches insulating a metal bolt with a composite structure made partially of insulating resins and conducting fibers. According to Berecz, the head of the screw is electrically insulated from the surface, but the lower portions of the fastener are electrically coupled to portions of the composite strip.

Pat. No. 2,186,482 to Frank teaches use of a copper sheath to bind two steel cores together for use as a ground rod to provide good coupling between the segments of the steel core. Pat. No. 2,181,835 to Place teaches use of a coating composition for screw-threaded elements.

While these patents discuss problems similar to those solved by the present invention, many of the solutions are not cost-effective for use on aircraft structures or do not provide the full lightning and static discharge protection needed for an aircraft. Pat. Nos. 4,628,402; 4,630,168 and 4,681,497 are cited but are not admitted as prior art to the present invention as described herein.

DISCLOSURE OF THE INVENTION

It is an object of the present invention to provide good electrical coupling between two sheets of composite structure and the fastener used to bond them together.

It is another object of the invention to provide for discharging electric charge buildup on the surface of a composite structure without arcing by use of a threaded fastener that electrically couples the surface regions and inner regions of the composite structure to each other and to ground.

It is another object of this invention to provide a method of connecting a composite structure to ground with an interference fit that provides good electrical coupling.

These and other objects of the invention are accomplished by providing a conductive fastener having threads contacting the composite structure and extending through the composite structure from one surface region, through an inner region, to the other surface region. The fastener is connected to ground. Washers are placed at the surface region, and the fastener is torqued. The fastener is installed in this manner to ensure that no voids are present between the two composite structures.

BRIEF DESCRIPTION OF THE DRAWINGS

FIG. 1 is a side cross-sectional view of two composite structures connected by a fastener according to the present invention.

FIG. 2 is a side cross-sectional view of an alternative embodiment of the present invention shown coupling two composite structures together.

DETAILED DESCRIPTION OF THE INVENTION

Two composite structures 20 and 22 are fastened together by a fastener 10 as shown in FIG. 1. Each composite structure includes an upper surface region 14, an inner region 15, and a lower surface region 13. This composite structure is a graphite/epoxy structure as presently used in many aircraft structures. The upper and lower surface regions 14 and 13, respectively, of the composite structures 20 and 22 are electrically insulating, while the inner region 15 contains graphite fibers which are electrically conductive. As the aircraft flies through the air, a static charge builds up on the surface regions 13 and 14. The surface regions 13 and 14 and inner region 15 may also be charged by a lightning strike.

The fastener 10 having head 18 has threads 26 along the portion of its length that is in contact with the composite structures 20 and 22. A nut 12 is secured at the other end of fastener 10. Washers 16 are placed between the fastener head 18 and nut 12 at the respective surface regions 14 and 13 of the composite structures 20 and 22 respectively. The surface regions 14 and 13 of the composite structures 20 and 22 respectively are abraded to expose the graphite where the washers 16 contact the composite structures. The fastener 10 is torqued on both the head 18 and the nut 12 according to the torque specified by industry standard according to bolt type. A conductive strap 30 can be connected to fastener 10, if desired, preferably by placing the strap 30 under the bolt head 18 prior to torquing. The conductive strap 30 is connected to other fasteners, system ground, or a different voltage potential, if desired. System ground for an airplane may be a different voltage potential than earth ground.

As mentioned above, the fastener threads 26 contact inner regions of the composite structures 20 and 22 thereby creating a contact 28 between the inner regions 15 of the composite structures and the fastener. The contact area 28 between the composite structure and the fastener 10 is significantly increased by use of threads 26. In fact, the use of threads can increase the contact area between the fastener 10 and the composite structures 20 and 22 by as much as 60 percent. The increased contact area significantly lowers resistance between the fastener and composite structure and permits much higher currents to pass from the composite structures 20 and 22 to the fastener 10 at lower temperatures.

As charge builds up on the surface regions 14 and 13 that are electrically coupled by washer 16 and nut 12 to fastener 10, discharge through strap 30 is provided without arcing. Further, electrical charge or current which is within inner region 15 due to fault current, stray electric charges, lightning strikes, etc., is conducted through threaded fastener 10 to strap 30 without arcing.

The fit between composite structures 20 and 22 and threaded fastener 10 is an interference fit. The threads 26 are firmly in contact with all portions of the composite structure. This is in contrast to a clearance fit wherein a hole is drilled through the structures which are to be fastened together and a bolt is placed through the hole to connect the structures together, as shown in Pat. No. 2,250,280. In a clearance fit, the hole is made slightly larger than the bolt so that the bolt may be placed through the hole for connecting to a nut at the other side. A clearance fit, even if machined to high tolerances, permits small air gaps or voids to exist between the inner region 15 at composite structure 20 and the fastener. As a result, sparks can jump through these gaps or voids when electricity discharges from the composite structures 20 and 22.

With an interference fit, the fastener 10 is in solid contact with all portions of the composite structures 20 and 22. As a result, there are no air gaps or voids to allow a spark to jump through nor can a static charge build up on the surface regions 13 and 14 since the surface regions 13 and 14 are connected to ground through the threaded fastener 10. Abrading the surface of the composite structures and torquing the fastener also aids to provide good electrical contact between the fastener and the surface regions to avoid arcing between them. To provide the interference fit between the composite structures and the threaded fastener 10, a hole is drilled in the composite structures but this hole is made somewhat smaller than the diameter of the threaded fastener. The threaded fastener solidly engages the composite structure as it is screwed into the structures contacting at the thread region and the inner shaft region of the screw. This provides a tight interference fit between the threaded fastener and the inner regions 15 of the composite structure with no voids therebetween. This results in preventing arcing between the composite structure and any portion of the fastener. Additionally, a conductive paint or conductive material may be placed between the composite structures, around threaded fastener 10, washers, head and nuts to improve the electrical coupling between the composite structures 20 and 22 and the fastener 10, if desired. An epoxy or polysulphide rubber fuel tank sealant having 20 percent carbospheres by dry volume is usable for this purpose.

The harmful arcing between the composite structure and fastener may occur across very small voids. Such voids may occur between the outer surface 14 and the nut, head or washer, especially if the fastener is notstraight. Similar voids may occur between the two composite structures 20 and 22. Voids may also occur between the fastener and the inner regions 15 of the composite structure. The inventive structure minimizes or eliminates all such voids. Localized heating of the composite structures and fastener due to arcing is thus minimized or eliminated. Further aiding to maintain a lower temperature is the large contact area between the fastener and composite structure.

Two composite structures 20 and 22 may be fastened together as shown in FIG. 1; however, the inventive structure may also be used if one composite structure is fastened to a metal member. In this event the fastener need not be threaded through the metal fastener, it is important that good electrical contact be made however.

FIG. 2 illustrates a second embodiment of the invention. Two composite structures 48 and 50 are fastened together by a fastener 46 having threads 52.

Each of these composite structures has a top surface region 60, a lower surface region 62 and an inner region 58. The surface regions 60 and 62 are insulating, while the inner regions 58 contain conductive fibers. In this particular embodiment of the invention, the fastener 46 has a self-drilling point 50 so that the fastener 46 can make its own hole as it is screwed into the composite structures. The fastener is torqued the amount specified by industry standards. This provides for complete contact between all portions of threaded fastener 46 and composite structures 48 and 50. The fastener also has an integral washer 56 and head 54. A ground strap 64 may be placed under the head 54 if desired. The threaded fastener 46 couples the two composite structures firmly together to ensure that no voids exist between the two composite structures and the threaded fastener 46. The fastener of FIG. 2 operates in a manner similar to the manner in which the fastener of FIG. 1 operates. That is, electrical charge buildup on surface region 60 and 62 is discharged through conductive fastener 46. There is an interference fit between the inner regions 58 of the composite structures to ensure that voids are eliminated to prevent arcing between the regions 58 and the fastener 46.

The present invention provides for electrically coupling two composite structures to each other in order to provide good conductivity between all portions of the composite structures. This also provides that all portions of the composite structure are held at the same electrical potential.

I claim:

1. An apparatus for preventing the destruction of graphite/epoxy composite material in an aircraft structure when said aircraft structure is struck by lightning comprising:

a first graphite/epoxy composite member coupled to said aircraft structure, said first composite member having an insulating surface region and an inner region including a plurality of individual conductive fibers;

a second graphite/epoxy composition member coupled to said aircraft structure, said second composite member having an insulating surface region and an inner region including a plurality of individual conductive fibers;

a fastener means having threads for attaching the first composite member to the second member, the fastener means contacting said surface region and being threadably coupled with an interface fit to the inner regions of both members for providing good electrical conductivity between the fastener means and individual fibers within each of the two members to prevent arcing between the fastener means and the composite members when lightning strikes said apparatus; and a member of good electrical conductivity coupled to the fastener means.

2. The apparatus according to claim 1 wherein said member is connected to system ground.

3. The apparatus according to claim 1 wherein the fastener attaches the two members together by an interference fit.

4. The apparatus according to claim 1 wherein the fastener is a self-drilling fastener that forms its own hole in the composite materials as it is screwed into the composite materials.

5. The apparatus according to claim 1 wherein the inner region has a lower conductivity than the fastener when both are at room temperature but a higher conductivity than the fastener when both are substantially above room temperature.

6. The apparatus according to claim 1 wherein said fastener is coupled to a voltage potential.

7. The apparatus according to claim 1 wherein the inner region includes graphite, the surface region includes epoxy, and the fastener is metal.

8. The method of forming an electrically conductive bond between a first composite structure, a second composite structure and a fastener to prevent arcing therebetween, comprising:

forming a hole in said first composite structure, said first composite structure including an electrically insulating surface region and an inner region having a plurality of individual electrically conductive fibers;

forming a hole in said second composite structure, said hole in said second composite structure being approximately the same diameter as said hole in said first composite structure, said second composite structure including an electrically insulated surface region and an inner region having a plurality of individual electrically conductive fibers;

abrading said surface region of said first composite structure adjacent said hole to increase the electrical conductivity between said fastener and said first composite structure; and screwing said fastener into said first composite structure, and said second composite structure to couple said first and said second composite structures together, the diameter of the fastener being greater than the diameter of said holes such that an interference fit between said first composite structure, said second composite structure and said fastener is provided without voids therebetween.

9. The method according to claim 8, further including the step of attaching a conductive member to said fastener, said conductive member being electrically coupled to a voltage potential.

10. An apparatus comprising:

a composite member having a surface layer of dielectric material and an inner region including a plurality of individual conductive fibers;

a second member;

a fastener means extending through said composite member and said second member for rigidly coupling said composite member to said second member, said fastener means having a head and a shank, said shank including threads extending along its entire length, from the head of said fastener to an end of said shank opposite said head said fastener means being threadably coupled with an interference fit to the inner region of said composite member; and a nut means threadably coupled to said end of said fastener opposite said head and being tightened to a predetermined torque for ensuring solid electrical contact between said nut, said composite member, said fastener means and said second member and that there are no voids between said nut, said fastener means, said composite material and said second member.

11. The apparatus according to claim 10 wherein said second member is a graphite/epoxy composite member and said fastener is threadably coupled with an interference fit to an inner region of said second member.

12. The apparatus according to claim 10 wherein said second member is an electrically conductive metal strap.

13. The apparatus according to claim 11, further including a third member coupled to said second member, said fastener extending through said third member and said third member being a conductive metal strap.

14. The apparatus according to claim 10 wherein said threads extending along said shank form a surface area of said fastener means wherein the surface area of said fastener means within said inner region is 60% greater than the surface area of a fastener means having the same diameter shank without threads thereon.

15. An apparatus for preventing the destruction of graphite composite material under a lightning strike, comprising:

a first composite member having a surface layer of dielectric material and an inner region including a plurality of individual conductive fibers;

a second composite member having a surface layer of dielectric material and an inner region including a plurality of individual conductive fibers;

a fastener means extending through said first composite member and said second member for rigidly coupling said first and second composite members to each other, said fastener means having a head and a shank, said shank including a threaded portion having threads, said threads contacting the inner region of said fist composite member and the inner region of said second composite member to couple said fastener to said composite members with an interference fit;

a metallic, electrically conductive grounding strap coupled to said fastener; and a nut means threadably coupled to said end of said fastener opposite said head and being tightened to a predetermined torque for ensuring solid electrical contact and that there are no voids between said nut and said grounding strap, said first composite member and said fastener, said second composite member and said fastener, and said first and second composite members for preventing electrical arcing therebetween under a lightning strike.

16. The apparatus according to claim 15 wherein the surface area of said fastener means within said inner region is 60% greater than the surface area of a fastener means having the same diameter shank without threads thereon.

17. The apparatus according to claim 15 wherein the diameter of said fastener is generally uniform along the entire length of the threaded portion.

* * * * *

UNITED STATES PATENT AND TRADEMARK OFFICE

CERTIFICATE OF CORRECTION

PATENT NO. : 4,920,449

DATED : April 24, 1990

INVENTOR(S) : James H. Covey

It is certified that error appears in the above-identified patent and that said Letters Patent is hereby corrected as shown below:

Column 7, line 16, "fist" should read "first".

Signed and Sealed this

Sixteenth Day of July, 1991

*Attest:*

HARRY F. MANBECK, JR.

*Attesting Officer*

*Commissioner of Patents and Trademarks*